US005959551A

United States Patent [19]

Cardillo

[11] Patent Number: 5,959,551

[45] Date of Patent: Sep. 28, 1999

[54] EMERGENCY VEHICLE APPROACH WARNING SYSTEM

[76] Inventor: Alfredo Cardillo, 16751 Curtis St., Roseville, Mich. 48066

[21] Appl. No.: 09/062,695

[22] Filed: Apr. 20, 1998

[51] Int. Cl.[6] ..... G08G 1/00

[52] U.S. Cl. ..... 340/902; 340/903; 340/539; 343/713

[58] Field of Search ..... 340/901, 902, 340/903, 905, 426, 539; 361/600, 679; 455/347, 348, 349, 350, 345

[56] References Cited

U.S. PATENT DOCUMENTS

| | | | |
|---|---|---|---|
| 2,805,399 | 9/1957 | Leeper | 339/177 E X |
| 3,094,663 | 6/1963 | Siegel | 455/347 |
| 3,710,313 | 1/1973 | Kimball et al. | 340/902 |
| 4,875,350 | 10/1989 | Faust | 70/241 |
| 5,808,560 | 9/1998 | Mulanax | 340/902 |
| 5,825,304 | 10/1998 | Marin | 340/903 |

*Primary Examiner*—Jeffrey A. Hofsass
*Assistant Examiner*—Van T. Trieu
*Attorney, Agent, or Firm*—Harness, Dickey & Pierce, P.L.C.

[57] ABSTRACT

For use in warning motorist, especially those who are hearing impaired, of an approaching emergency vehicle, a new and useful invention comprises a transmitter which is installed into an emergency vehicle and activated upon an emergency run. A low frequency signal is sent out over the emergency vehicles original equipment antenna system and is picked up by motorist having a receiver unit mounted to their dash panel. The signal is processed into visual and audio warnings whenever a transmitting emergency vehicle is within close proximity to the receiving vehicle. The receiver is on full time when the motor vehicle is in operation thereby allowing suitable response time for motorist to take appropriate action in yielding to the emergency vehicle. The transmitter does however have an on/off switch as well as a visual and audio means for monitoring the transmitted signal.

14 Claims, 2 Drawing Sheets

EMERGENCY VEHICLE APPROACH WARNING SYSTEM

TECHNICAL FIELD

The following invention relates in general to devices used by emergency vehicles, such as a police car or ambulance, and more particularly to electronic warning devices used to alert approaching motorist of the need to yield to the emergency vehicle.

BACKGROUND OF THE INVENTION

There are many instances where public safety vehicles, whether police cars or ambulance, use a combination of visual and audio means to alert other motorist and pedestrians to give the right away to these vehicles. These visual and audio means include sirens and emergency flashers. Other vehicles which use any combination of the two include fire trucks, tow trucks and utility repair vehicles. Depending on the level of the emergency, whether it be a heart-attack victim on the way to a hospital in an ambulance or a road crew patching holes in the pavement, the combination of audio and visual warning devices, for the most part, are adequate in alerting the public as to their presence and the need to yield.

There are many instances however, where emergency vehicles fall short in their ability to warn the public at large as to presence and intentions. For an example, during the daylight hours emergency flashers and beacons are harder to spot than they would be at night. As well as a siren may be harder to detect when a motorist is using the car radio. Because of these shortcomings, many emergency vehicles become involved in traffic accidents resuiting in loss of life. In most situations, participants in the accident simply did not have ample warning of the approach of the emergency vehicle. In the situation where the police are chasing a vehicle which refuses to pull over, no siren or flasher is used on that particular vehicle resulting in an even greater number of accidents. Another problematic situation is with public buses or school buses. The use of these flashing warning lights simply does not allow ample response time to other motorist, again resulting in accidents and injury.

In still another problematic area, our population is living longer resulting in a growing number of senior citizens. As the senior population grows, the number of senior drivers grows. The response time adequate for these drivers to comprehend and react accordingly to emergency vehicles is an even greater problem as one's eyesight and hearing are greatly affected with age.

In light of these problems with public safety vehicle warning systems, it is a main object of the present invention to provide an electronic warning device which comprises a transmitting unit which is activated during an emergency vehicle run. The transmitting unit sends out a low frequency signal to receiving units installed in motor vehicles. As an emergency vehicle passes through any given area, the low frequency signal over-rides ones car radio with an intermittent beep and warning light.

Another object of the present invention is to provide a computer chip for use with an automobiles ECM (electronic control module). For use in alerting those who have a hearing problem of the approach of an emergency vehicle, the chip receives activation from a receiving unit and turns on a readily visible blinking light installed in the dash area of the motor vehicle.

Another object of the present invention is to provide a receiving unit for motorcyclist which can pick up a signal from an emergency vehicle and display the signal in the form of an emergency flasher.

It is another object of the present invention to provide a fixed transmitter which can be located near schools, playgrounds and neighborhoods where children, including handicap children, are playing. The fixed transmitter could be solar powered and would send out a low frequency signal to motorist having a receiving unit. The signal would alert motorist with a flashing beacon which could be an original equipment item from the manufacturer, or a ready-to-use aftermarket unit which would plug into ones cigarette lighter.

SUMMARY OF THE INVENTION

In light of the foregoing problems, and to fulfill the above stated objects, there is provided, according to one aspect of the invention, an early warning system for use in motor vehicles used to send out a low frequency signal to motorist within a 1,000 feet radius thereby alerting them that the need to yield the right of way is possible, or to be prepared for an approaching emergency vehicle. The two part system comprises a transmitter for the emergency vehicle and a receiver for the motor vehicle at large. The primary embodiment of the present invention comprises a transmitter box which is mounted to the dash board in close proximity to the other transmitting equipment standard in emergency vehicles in order to tie into the existing antenna. When activated, the transmitter would send out an intermittent low frequency signal, designated by the FCC, which would be picked up by motor vehicles equiped with a receiving unit as long as they are within a 1,000 foot radius of the transmitter.

The transmitter comprises a plastic injection molded housing and has an open back. Located within the housing are opposing wall slots which receive a transmitter circuit board of the type common in low frequency transmitting devices. The transmitter has a power supply which is attached to the hot side of the vehicle fuse box and further has an in-line fuse link. Located along the face of the unit is an on/off switch and a dial use to increase the signal. The on/off switch has a beacon which pulsates simultaneously with the low frequency signal. As another embodiment of the transmitter, the power supply line has a plastic covered lance coupling which can be directly connected to the supply power line of the other on-board emergency equipment. This ensures the automatic use of the present invention transmitter, any time the vehicles on-board emergency equipment is in use. Located along the outer walls of the housing are attachment flanges which have access apertures receivable of self-tapping sheet metal screws of the type commonly use with a cord-less hand drill. To attach the transmitter, one simply holds the unit in the desired fixed location and drills two screws, one through each aperture, until snug against the dash member of the vehicle. Situated from the rear of the transmitter housing is an antenna which has a coaxial connector adapter for use with the emergency vehicle antenna. The original equipment antenna is severed and the adapter is fitted over each end and crimped. Once installed the antenna is able to send out all pre-existing signals, or receive them, without interference from the low frequency signal being sent by the present invention.

The receiving unit of the present invention comprises, as a main embodiment of the present invention, a plastic injection molded housing which is receivable of a low frequency receiver board. The housing has two opposing wall flanges with apertures and as the housing is fitted to the under-dash of a motor vehicle, self-tapping sheet metal screws are installed through the apertures and into the dash substrate. Extending from the rear of the housing is a power supply line, a radio interrupter line and an antenna connection adapter. The power supply line has a built-in fuse link and is adapted for connection to the fuse box of the automobile. The radio interrupter line has a plastic shielded lance which is fitted over the ground wire of the vehicle stereo system wherein the lance is made to puncture the ground lead and communicate with the lead. The antenna adapter has a "tee" receptacle comprising the terminal end of the antenna coaxial lead. The "tee" has a female opening which is adapted to receive the original equipment antenna which is disconnected from the vehicle stereo system. Extending away from the opposite end of the "t" is an antenna lead continuation of the antenna circuit which is adapted for re-connection to the stereo system. When the stereo system is turned on, regardless of the volume, and an emergency vehicle is approaching with the present invention transmitter in operation, the receiving unit picks up the signal and activates a beacon light and beeper located in the facing of the housing.

In situations where the vehicle stereo system is played at a high volume, and the operator does not hear or see the warning, the ground wire splice sends an interference signal which disrupts the stereo play.

BRIEF DESCRIPTION OF THE DRAWINGS

In the drawings where like reference numerals are used to indicate identical components in the various figures.

DETAILED DESCRIPTION OF THE EMBODIMENTS

Figure 1:
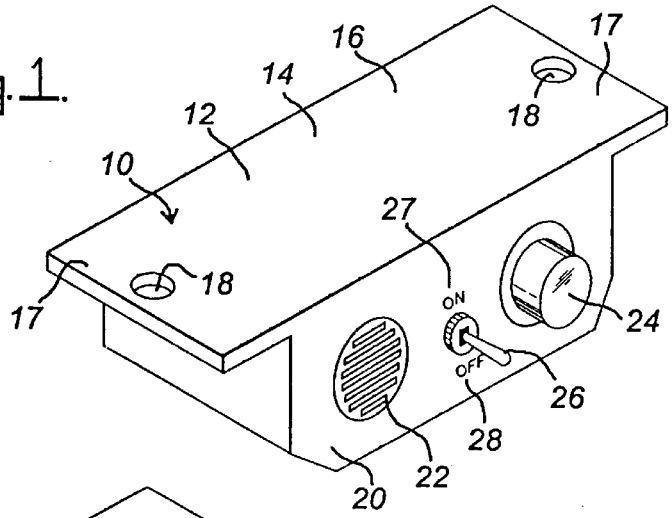
FIG. 1 is a perspective view of the transmitter unit of the present invention at the point of installation to the under-dash of an emergency vehicle.

With combined reference to all the drawing figures, an emergency vehicle approach warning device is generally denoted by the numeral 10. As depicted in FIG. 1, the invention 10 has a transmitter unit 12 comprised of an injection molded plastic shell 14. The shell 14 has a top surface 16 having opposing flanges 17 and fastener apertures 18. The unit 12 is designed for attachment to the under-dash of a vehicle (not shown). Located to the front of the unit 12 is a display face 20 having a speaker 22, a toggle switch 26 having an on position 27 and an off position 28. Also located along the display face 20 is a light beacon 24.

Figure 2:
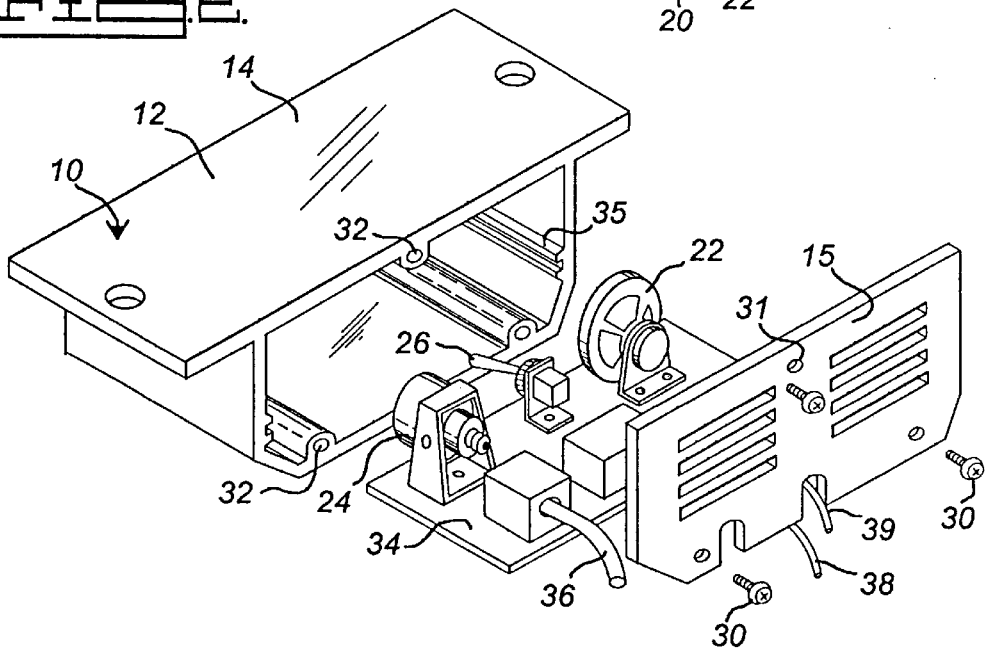
FIG. 2 is an exploded view of the transmitter taken from a rear perspective and further depicting the circuit board array comprising a beacon, toggle switch and speaker.

FIG. 2 shows the invention transmitter 10 and 12 from the rear. The shell 14 has opposing guide tracks 35 which receive a circuit board 34. The board 34 comprises a speaker 22, a toggle switch 26 and a beacon 24. Extending from the board 34 is an antenna coaxial lead 36, a hot lead 38 and a ground wire 39. The shell 14 has a back cover 15 which has opposing apertures 31 adapted for fasteners 30. The fasteners 30 extend through the apertures 31 and into screw bosses 32.

Figure 3:
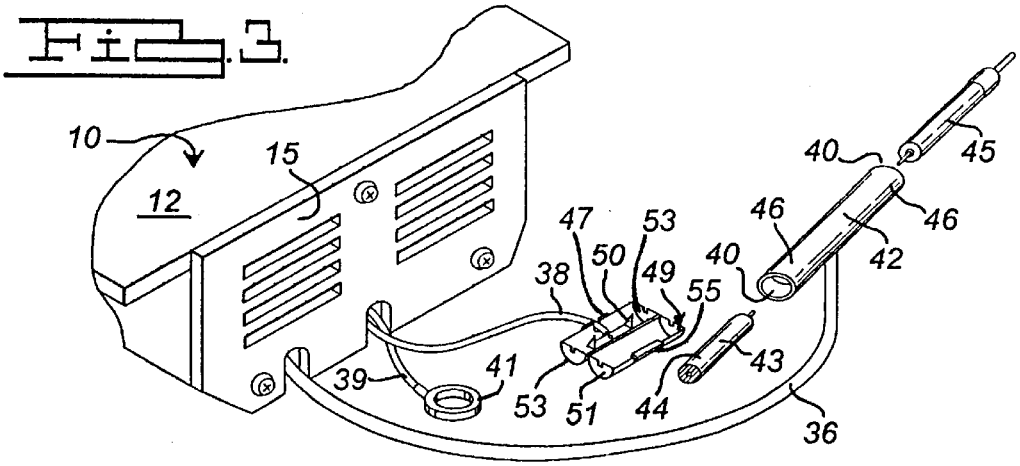
FIG. 3 is a fragmentary perspective view of the wiring and coaxial antenna taken from a rear perspective.

As seen in FIG. 3, the invention 10, having a transmitting unit 12, is again shown from a rear position. Extending through the back cover 15 of the unit 12 is an antenna 36 having a junction terminal 42. The terminal 42 has recess openings 40 which are adapted to receive the severed ends 44 and 45 of a vehicle antenna 43. Once inserted into the recess openings 40, the installer crimps the ends 46. The previously severed end 45 is then reconnected to the host vehicle (not shown). Further extending from the back cover 15 is a ground-wire 39 and a positive hot-wire 38 which has a plastic clam shell capsule 49 shown here open thereby exposing a metallic lance 50 used to puncture a vehicles power supply wire upon snapping the capsule lid 51 shut. The ground wire 39 includes a metallic eyelet terminal 41 to be connected to a self-tapping, threaded fastener and a metallic grounded portion of the vehicle-assembly. The clam shell capsule 49, including the lance 50 connected to the wire 38, is used to pierce the insulated positive lead of a vehicle wiring harness (not shown). The clam shall capsule 49 includes end walls 43 that bias the vehicles positive lead against the lance 50 upon closing the clam shell capsule 49. The clam shell capsule 49 includes tab members 45 and 47 for locking the clam shell capsule 49 shut.

Figure 4:
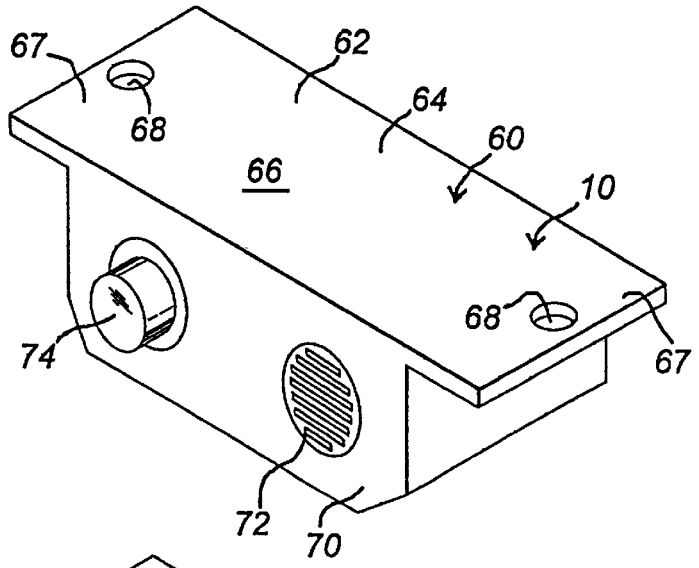
FIG. 4 is a perspective view of the receiver unit of the present invention, as a preferred embodiment, at the point of installation to a motor vehicle under, or over-dash.

FIG. 4 depicts the receiving unit 60 of the present invention 10 wherein a housing 66 comprises an injection molded shell 62. The shell 62 has a planar top surface area 64 having opposing flanges 67 and apertures 68. Upon orientation of the unit 60 to the under-dash of a vehicle (not shown), one inserts screws through the apertures 68 and tightens the top surface 64 to the under-dash. Located within the sight of a motor vehicle operator, the unit 60 has a face 70 comprising a beacon 74 and a speaker 72.

Figure 5:
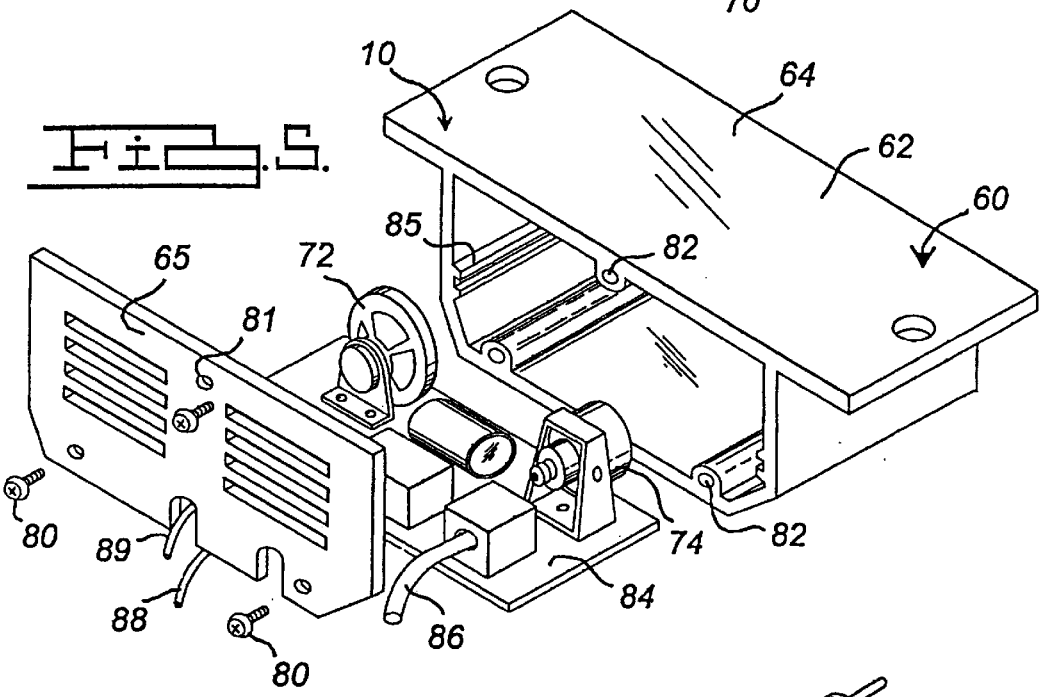
FIG. 5 is an exploded view of the receiver unit taken from a rear perspective and further depicting the circuit board array comprising a beacon and speaker.

As seen in FIG. 5, the present invention 10 has a receiver unit 60 which when activated communicates to receive low frequency signals from the transmitter 12. The receiver unit 60 comprises a shell 62 having a top mounting surface 64 adapted for attachment to a vehicle dash. The shell 62 has opposing guide tracks 85 which receive the circuit board 84 which is held in place by the back cover 65. The back cover 65 has a plurality of screw boss members 82 which communicate with fasteners 80 installed through apertures 81 and into the boss members 82. Located on the circuit board 84 is a speaker 72 and a beacon 74. Extending from the back of the unit circuit board 84 is a co-axial antenna 86 and a positive lead wire 88 and a ground wire 89. The receiver unit 60 can also include a metallic eyelet terminal for the ground wire 89 and a clam shell capsule for the positive lead wire 88 of the type described above for the transmitter unit 12.

Figure 6:
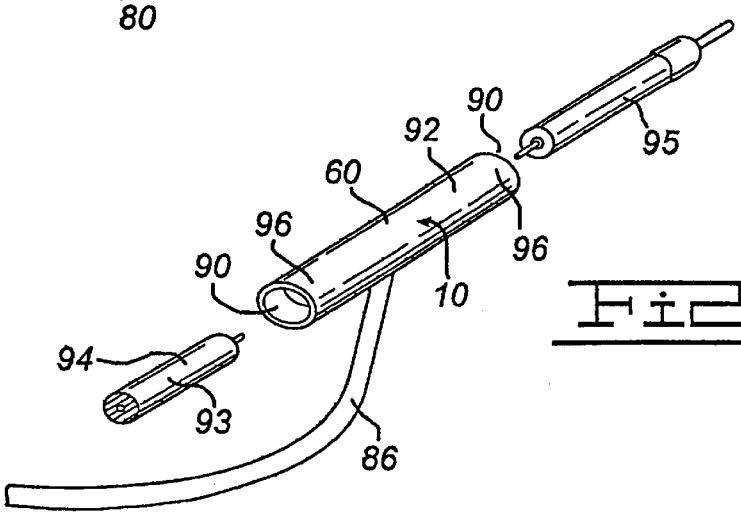
FIG. 6 is a fragmentary perspective view of the coaxial antenna receiving the severed ends of the original equipment antenna of a motor vehicle.

FIG. 6 shows the present invention 10, having a receiver unit 60 and antenna 86, further depicts the juncture terminal 92 which receives the severed ends of the original equipment antenna 93, the severed ends shown as 94 and 95. The first severed end 94 is inserted into the recess opening 90 and crimped at the terminal end 96. The second severed end 95 is then inserted into the recess opening 90 and crimped at the end 96.

While the foregoing embodiments of the present invention are well suited to achieve the above stated objects, those skilled in the art should realize the such embodiments are subject to modification, alteration and change without departing from the scope of the present invention. For example, the present invention transmitter and receiver units could be rotated 180 degrees and installed with the mounting surfaces downward. As another example, the present invention could be used to alert motorist of a school bus stopped to unload passengers. In still another example, the transmitter unit of the present invention could be modified to communicate with a computer chip installed as original equipment in motor vehicles, and upon receiving a transmitted signal (from police), would shut down the vehicle ignition source during a high speed chase thereby saving many lives.

What is claimed is:

1. For use in providing an audio and visual warning of an approaching emergency vehicle;

a transmitting and receiving device comprising an injection molded plastic shell having open backs receivable of transmitting and receiving circuit boards along guide tracks molded into side walls of the plastic shell;

audio means for providing the audio warning;

visual means for providing the visual warning;

a means for mounting the transmitting and receiving devices into emergency vehicles and motor vehicles respectively;

a means for attaching the transmitting and receiving antennas to emergency and motor vehicles respectively, wherein said means for attaching transmitting and receiving antennas to emergency and motor vehicles includes a coaxial lead extending from their respective transmitting and receiving devices, said transmitting and receiving antennas further including a cylindrical juncture connected to a terminal end of the said lead, said juncture including openings at each end for receiving severed and prepared ends of the original equipment vehicle antenna, wherein the ends of the juncture are crimped to electrically connect the severed ends of the original transmitting and receiving antenna; and a means for attaching positive and negative leads to existing emergency and motor vehicles respectively.

2. The device as described in claim 1, wherein said audio means comprises an integrated speaker rigidly fixed to said circuit board and aligned with a slotted opening in said shell, wherein said speaker is wired into said circuit board and turns low frequency signals into audio beeps.

3. The device as described in claim 1, wherein said visual means includes a beacon member rigidly fixed to the said circuit board and aligned with a lens covered opening in said shell, wherein said visual warning beacon is wired into the said circuit board and flashes light in conjunction with said audio warning.

4. The device as described in claim 1, wherein said means for mounting said transmitting and receiving devices comprises a top planar surface area adapted for flush communication with a planar surface area of emergency and motor vehicle dash boards, said top planar surface having opposing apertured flanges adapted to receive a plurality of fasteners of the type used to self tap and thread into a metallic substrate.

5. The device as described in claim 1, wherein said means for attaching positive and negative leads to emergency and motor vehicles further comprises insulated positive and negative wires extending from the said circuit board, wherein the negative lead terminates with a metallic eyelet terminal adapted for use with a self-tapping/threading fastener into a metallic grounded portion of the vehicular dash assembly, while said positive lead further comprises a plastic clam shell capsule having an interior cavity receivable of a metallic lancing terminal, said lancing terminal comprising the terminal end of the positive lead extending into the capsule cavity.

6. The device as described in claim 5, wherein said positive lead, having a clam shell capsule comprising the terminal end of the lead, and having a lancing terminal for piercing the insulated positive lead of a vehicles wiring harness, said capsule having end walls for biasing the vehicles positive lead against the lancing terminal upon closing the clam shell, said clam shell having tab members for locking one to another.

7. The device as described in claim 1, wherein said transmitting device further comprises a toggle switch for activating and deactivating the transmitting device.

8. For use in providing an audio and visual warning of an approaching emergency vehicle;

a transmitting and receiving device comprising an injection molded plastic shell having open backs receivable of transmitting and receiving circuit boards along guide tracks molded into side walls of the plastic shell;

an audio device for providing the audio warning;

a visual device for providing the visual warning;

a device for mounting the transmitting and receiving devices into emergency vehicles and motor vehicles respectively;

a device for attaching the transmitting and receiving antennas to emergency and motor vehicles respectively; and a device for attaching positive and negative leads to existing emergency and motor vehicles respectively, wherein said device for attaching positive and negative leads to emergency and motor vehicles includes insulated positive and negative wires extending from the circuit boards, wherein the negative lead terminates with a metallic eyelet terminal adapted for use with a self-tapping/threading fastener and a metallic grounded portion of a vehicular dash assembly, and said positive lead includes a plastic clam shell capsule having an interior cavity in which is mounted a metallic lancing terminal, said lancing terminal being connected to the terminal end of the positive lead extending into the capsule cavity.

9. The device as described in claim 8, wherein said audio device includes an integrated speaker rigidly fixed to said circuit board and aligned with a slotted opening in said shell, wherein said speaker is wired into said circuit board and turns low frequency signals into audio beeps.

10. The device as described in claim 8, wherein said visual device includes a beacon member rigidly fixed to the circuit boards and aligned with a lens covered opening in said shell, wherein said visual warning beacon is wired into the circuit boards and flashes light in conjunction with the audio warning.

11. The device as described in claim 8, wherein said device for mounting said transmitting and receiving devices includes a top planar surface area adapted for flush communication with a planar surface area of emergency and motor vehicle dash boards, said top planar surface having opposing apertured flanges adapted to receive a plurality of fasteners of the type used to self tap and thread into a metallic substrate.

12. The device as described in claim 8, wherein said device for attaching transmitting and receiving antenna to emergency and motor vehicles includes a coaxial lead extending from their respective transmitting and receiving devices, said antenna further having a juncture at the terminal end of the said lead for receiving the severed and prepared ends of the original equipment antenna into recessed openings at either end of the juncture, whereas upon receiving said severed ends, a crimping tool is used to bias the said ends into said recessed openings.

13. The device as described in claim 8, wherein said positive lead, having a clam shell capsule comprising the terminal end of the lead, and having a lancing terminal for piercing the insulated positive lead of a vehicles wiring harness, said capsule having end walls for biasing the vehicles positive lead against the lancing terminal upon closing the clam shell, said claim shell having tab members for locking one to another.

14. The device as described in claim 8, wherein said transmitting device includes a toggle switch for activating and deactivating the transmitting device.

* * * * *